United States Patent [19]

Bitoune et al.

[11] 4,413,241

[45] Nov. 1, 1983

[54] TERMINATION DEVICE FOR AN ULTRA-HIGH FREQUENCY TRANSMISSION LINE WITH A MINIMUM STANDING WAVE RATIO

[75] Inventors: Sylviane Bitoune; Pierre Dufond; François Herrbach; Maurice Lecreff, all of Paris, France

[73] Assignee: Thomson-CSF, Paris, France

[21] Appl. No.: 281,393

[22] Filed: Jul. 8, 1981

[30] Foreign Application Priority Data

Jul. 11, 1980 [FR] France ..... 80 15497

[51] Int. Cl.[3] ..... H01P 1/26

[52] U.S. Cl. ..... 333/22 R; 333/246; 338/61

[58] Field of Search ..... 333/22 R, 81 A; 338/61, 338/216

[56] References Cited

U.S. PATENT DOCUMENTS

| | | | |
|---|---|---|---|
| 3,582,833 | 6/1971 | Kordos | 333/22 R |
| 3,678,417 | 7/1972 | Ragan et al. | 333/22 R |
| 3,761,846 | 9/1973 | Tsuboi | 338/216 X |
| 4,267,531 | 5/1981 | Spinner et al. | 333/22 R |

FOREIGN PATENT DOCUMENTS

| | | | |
|---|---|---|---|
| 53-76728 | 7/1978 | Japan | 333/22 R |
| 53-82147 | 7/1978 | Japan | 333/22 R |

*Primary Examiner*—Paul L. Gensler

*Attorney, Agent, or Firm*—Oblon, Fisher, Spivak, McClelland & Maier

[57] ABSTRACT

A termination device for a transmission line in which it is desired to reduce to a minimum the standing wave ratio resulting from the reflection of microwaves on a resistive load positioned at the end of the line. For this purpose and more particularly for a microstrip line comprising a conductor deposited on a dielectric substrate, whose lower face is metallized (earth plane), the conductor is extended by a trapezoidal resistive film, whose narrow end is connected to a metal coating connected to earth. Moreover, in order to compensate for the inductance of the load, two capacitors formed by metal deposits deposited on the substrate are connected to the resistive film.

8 Claims, 6 Drawing Figures

TERMINATION DEVICE FOR AN ULTRA-HIGH FREQUENCY TRANSMISSION LINE WITH A MINIMUM STANDING WAVE RATIO

BACKGROUND OF THE INVENTION

The invention relates to a termination device for a transmission line in which it is desired to reduce to a minimum the standing wave ratio resulting from the reflection of microwaves on a resistive load placed at the end of the line.

Such resistive loads, whose value is equal to the modulus of the characteristic impedance of the transmission line, are often produced in the form of a deposit made on an insulating material, particularly a nickel-chrome alloy film deposited on an insulating ceramic.

This method is of interest in the case of microstrip lines, e.g. in the production of directional couplers in which there is a so-called decoupled channel in which all the ultra-high frequency energy has to be absorbed, even in frequency bands up to 20 GHz.

It is also applicable to lines with two earth planes or striplines, as well as to coplanar lines.

In all cases the absorbing load must meet two requirements:

1. have an impedance, whose real part is equal to the characteristic impedance of the line;
2. have an imaginary part which is as close as possible to zero.

The first condition can easily be satisfied in the case of loads deposited by using a conventional process, which can be adjusted by erosion using a sand jet or by etching using a laser beam.

It is more difficult to satisfy the second condition because capacitive or inductive effects occur due to the substantial surface area and to the irregularities of the nickel-chrome film. Neither the width, nor the length, nor the two dimensions of this surface can be reduced without certain disadvantages occurring. Thus, a thinner film of nickel-chrome, i.e. which is more resistive and consequently has a smaller surface, is unable to withstand certain thermal dissipations, which limits the power behaviour of the device. The film of normal thickness, but e.g. narrower and longer to have the same surface would give a discontinuity or gap and consequently an energy reflection, producing undesirable standing waves at the transition point between the microstrip line conductor and the resistive film.

BRIEF SUMMARY OF THE INVENTION

The problem of the invention is to obviate these disadvantages by attempting to correct the impedance of the resistive load, either by modifying its shape, or by adding a capacitance thereto, or finally by combining the two aforementioned means.

The device according to the invention comprises a conductor constituted by a metal strip deposited on an insulating substrate and at least one earth electrode, the metal strip being connected by its end to a resistive film, which is itself connected to earth, wherein the resistive film has a decreasing width between its points of connection to the metal strip and to the earth.

According to a variant of the invention a load device comprises a conductor constituted by a metal strip deposited on an insulating substrate and at least one earth electrode, the metal strip being connected by its end to a resistive film, itself connected to earth, wherein the self-inductance of the resistive film is compensated, in the operating frequency range, by at least one conductive deposit capacitively coupled to said earth electrode and electrically connected to said resistive film.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
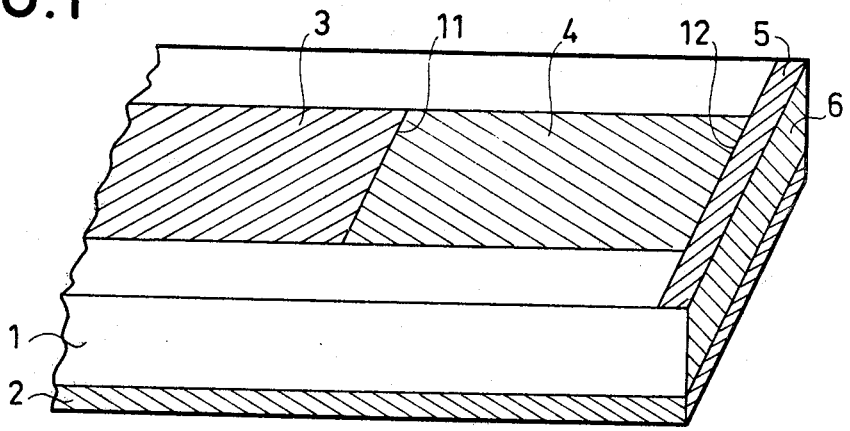
FIG. 1 a perspective view of a microstrip line terminated by a resistive film.

In FIG. 1 a microstrip line element comprises a dielectric substrate 1, e.g. of pure alumina, in the form of a flat, elongated parallelepiped having two large faces. One of its faces is entirely metallized and constitutes the earth plane 2, whilst the other is only metallized over part of its width and constitutes a strip 3 forming the upper conductor of the microstrip line. This strip is produced, for example, by successively depositing films of chrome, copper and gold. It is connected along a transverse straight line 11 to a resistive alloy film 4 constituting a termination load. Film 4 is itself connected along a transverse straight line 12 to a metal coating 5 connected to the earth plane by a negligible ohmic resistance connection. The connection to the earth plane can be effected either by etching the terminal face 6 of the substrate, or by welding a not shown flexible metal strip, or even by a not shown metallized hole between metal coatings 5 and 2.

Film 4 is constituted, for example, by a nickel-chrome alloy deposit, effected by vacuum evaporation and reaching a few hundred angströms in thickness. Using this method it is possible to obtain a film resistance of 25 ohms per square. In order to obtain a resistance of 50 ohms between lines 11 and 12 a deposit which is twice as long as it is wide is formed i.e. in the case of a 0.4 mm thick alumina substrate and a 0.3 mm wide strip 3 substantially giving a microstrip line of 50 ohms a 0.7 mm long film 4 forms the resistive termination.

The nickel-chrome alloy deposit can advantageously be made over a greater length than is necessary, in such a way that it is then possible to easily adjust the useful length by depositing a gold film on the parts to be short-circuited whilst protecting, during the gold-coating operation, the useful part of the load by means of a resin film obtained by photomasking.

In the chosen example the standing wave ratio noted for a frequency of 18 GHz exceeds 3. This is more particularly due to the fact that at such a frequency the wavelength in the propagation medium (the alumina of the substrate) is 6.5 mm, compared with which the 0.7 mm length of a resistive film is by no means negligible. Thus, the resistance does not act like a localized constant, which partly explains the high standing wave ratio observed.

Figure 2:
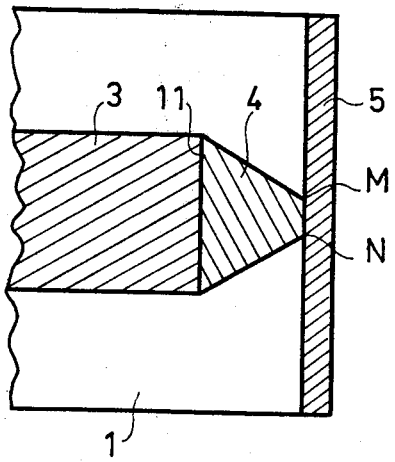

In a first embodiment of the invention diagrammatically represented in FIG. 2 film 4 is shaped like a trapezoid, whose large base is the connecting line 11 and the small base MN is connected to the metal coating 5 over a minimum length, whilst obtaining a good earth return contact, i.e. approximately 0.03 mm. If a and b are the respective lengths of line 11 and base MN, the resistance R (ohms) of the load is given by the formula:

$$R = \frac{R_o h}{a - b} \text{Ln} \frac{a}{b}$$

in which $R_o$ designates the resistance per square (in ohms) of the resistive film 4, h is the height of the trapezoid formed by said film and "Ln" signifies that the neperian logarithm of the a/b ratio is used.

For example with $$R_o = 26 \text{ ohms}$$
$$a = 0.35 \text{ mm}$$
$$b = 0.03 \text{ mm}$$
$$h = 0.25 \text{ mm}$$

a load of 50 ohms and a standing wave ratio of approximately 1.7 is obtained for a frequency of 18 GHz.

Figure 3:
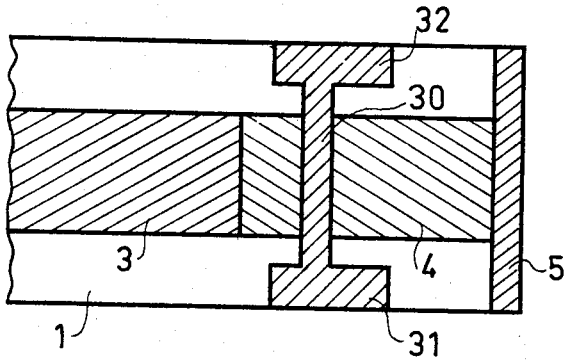
FIGS. 2 to 6 diagrammatically various constructions according to the invention.

In a second embodiment diagrammatically shown in FIG. 3 film 4 is again given a rectangular shape and has the same width as strip 3. However, a transverse conductive strip 30 is intercalated leading to two metal coatings 31 and 32 forming the foils of capacitors, whose other foil is the earth plane. For example the two metal coatings have a width of 100 microns and a length of 300 microns and are interconnected by a 100 micron wide strip 30 at a distance of approximately 200 microns from line 11. For 350 micron width of strip 3, the standing wave ratio observed is, for example, 1.6 at 18 GHz.

Figure 4:
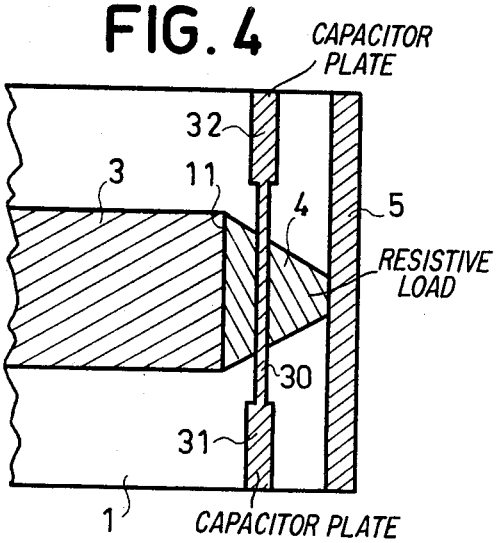

According to a third embodiment diagrammatically represented in FIG. 4 the two aforementioned embodiments are combined. Standing wave ratios of 1.3 are obtained for a frequency of 18 GHz with a strip 30 at 50 microns from line 11 and foils with dimensions 100×150 microns.

Figure 5:
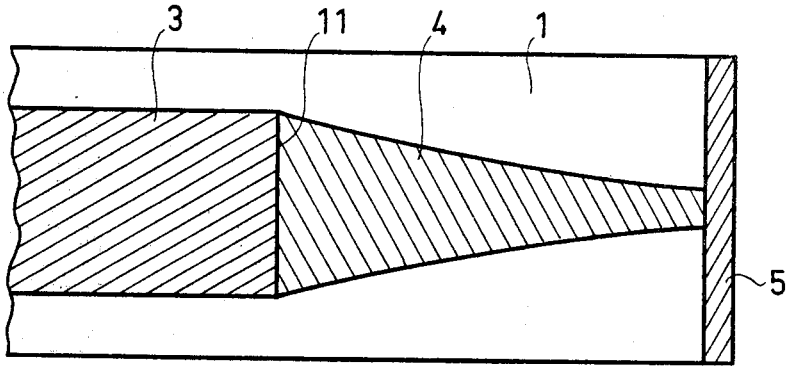

The resistive load can also be formed by a strip whose width decreases in accordance with a non-linear decay law. In the example illustrated by FIG. 5 the decrease in the width of strip 4 becomes smaller and smaller on moving away from line 11 separating strip 3 from the resistive load.

The invention is also applicable to striplines where two earth planes are separated from a single central strip by two dielectric substrates. The central strip can be arranged in the same way as has been described relative to FIGS. 2 to 5.

Figure 6:
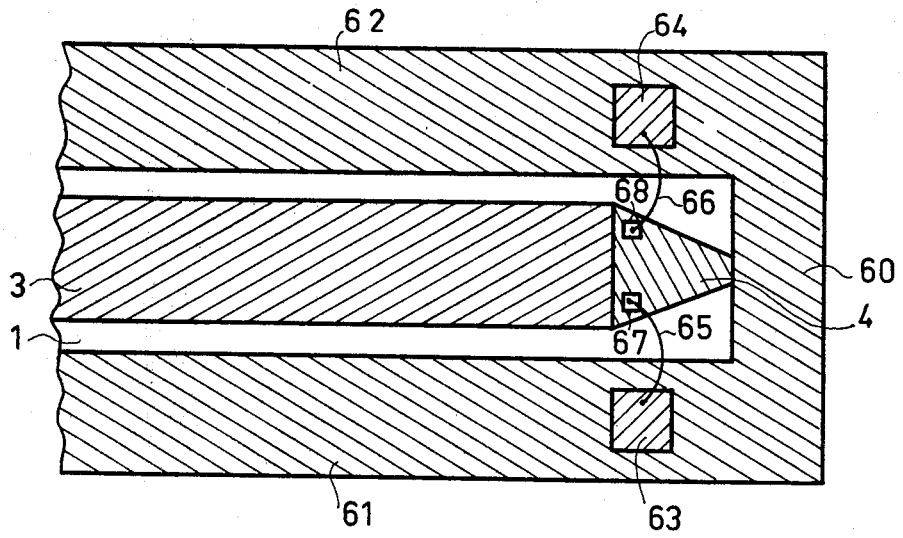

The invention is also applicable to coplanar lines. For example FIG. 6 shows one end of such a line having on a substrate 1, which is only visible between the metal coatings, a conductive strip 3 deposited between two lateral strips 61 and 62 deposited at the same time as strip 3 and interconnected by a deposit 60 of the same type and forming the earth return. A resistive film 4 having the same trapezoidal shape is deposited so as to be connected on the one hand to strip 3 and on the other to deposit 60. Capacitors 63 and 64 are constituted by insulating deposits on strip 61 and 62, said deposits then being covered by a conductive film connected to film 4 by connections 65 and 66, joined to film 4 by two small zones 67 and 68 constituted by gold deposits.

Capacitors 63 and 64 can also be formed by bare chips of ceramic capacitors.

What is claimed is:

1. A load device adapted to the characteristic impedance of a transmission line with a flat structure, comprising a conductor constituted by a metal strip deposited on an insulating substrate and at least one earth electrode, the metal strip being connected by its end to a resistive film, which is itself connected to earth, wherein the resistive film is of a decreasing width along the entire length between its points of connection to the metal strip and to earth, and wherein said resistive film is shaped like a trapezoid, whose large base is connected to the conductor and whose small base is connected to the earth plane.

2. A device according to claim 1 wherein the resistive film is interrupted by a transverse conductive strip located closer to the conductor than to the point of connection to earth, two conductive deposits being formed on the substrate on either side of the large sides of the trapezoid and interconnected by the conductive strip.

3. A device according to claim 1 wherein the line is of the type having two earth planes.

4. A device according to claim 1, wherein the transmission line is of the coplanar type comprising a central conductor and two lateral conductors, wherein said large base of said trapezoid is connected to said central conductor and said small base of said trapezoid is connected to said lateral conductors forming said earth plane.

5. A device according to claim 4, wherein the resistive film is electrically connected to conductive deposits forming inductance compensation capacitances with the lateral conductors.

6. A device according to claim 4, wherein the resistive film is connected to bare chips of ceramic capacitors placed on the lateral bare chips conductors.

7. A load device adapted to the characteristic impedance of a transmission line with a flat structure comprising a conductor constituted by a metal strip deposited on an insulating substrate and at least one earth electrode, the metal strip being connected by its end to a resistive film, itself connected to earth, wherein the self-inductance of the resistive film is compensated, in the operating frequency range, by at least one conductive deposit capacitively coupled to said earth electrode and electrically connected to said resistive film and wherein the resistive film is of a decreasing width along the entire length between its point of connection to the metal strip and to earth.

8. A device according to claim 7, wherein the resistive film is shaped like a trapezoid, whose large base is connected to the conductor and whose small base is connected to the earth plane.

* * * * *